US009723660B2

(12) United States Patent
Wang et al.

(10) Patent No.: US 9,723,660 B2
(45) Date of Patent: Aug. 1, 2017

(54) POST-MOUNTED LIGHT EMITTING DIODE (LED) DEVICE-BASED LAMP AND POWER SUPPLY FOR SAME

(75) Inventors: Jian Wang, ShaanXi (CN); Hong Zhao, ShangHai (CN)

(73) Assignee: GENERAL ELECTRIC COMPANY, Schenectady, NY (US)

( * ) Notice: Subject to any disclaimer, the term of this patent is extended or adjusted under 35 U.S.C. 154(b) by 422 days.

(21) Appl. No.: 13/878,769

(22) PCT Filed: Aug. 26, 2011

(86) PCT No.: PCT/US2011/049264
§ 371 (c)(1),
(2), (4) Date: Apr. 11, 2013

(87) PCT Pub. No.: WO2012/050668
PCT Pub. Date: Apr. 19, 2012

(65) Prior Publication Data
US 2013/0200813 A1 Aug. 8, 2013

(30) Foreign Application Priority Data
Oct. 15, 2010 (CN) ..... 2010 1 0526537

(51) Int. Cl.
*H05B 33/08* (2006.01)

(52) U.S. Cl.
CPC ..... *H05B 33/0809* (2013.01); *H05B 33/0803* (2013.01); *H05B 33/0815* (2013.01)

(58) Field of Classification Search
CPC ... B23K 11/248; H02M 1/02; H05B 33/0803; H05B 33/0809; H05B 33/0815; H05B 37/029; H05B 41/44; F02P 3/0435
(Continued)

(56) References Cited

U.S. PATENT DOCUMENTS 5,757,144 A 5/1998 Nilssen
2004/0232775 A1 11/2004 Nilssen
(Continued)

FOREIGN PATENT DOCUMENTS

CN 200955693 Y 10/2007
CN 201028361 Y 2/2008
(Continued)

OTHER PUBLICATIONS

Unofficial English translation of Office Action issued in connection with corresponding CN Application No. 201010526537.3 on Dec. 2, 2014.

(Continued)

*Primary Examiner* — Lincoln Donovan
*Assistant Examiner* — David Mattison
(74) *Attorney, Agent, or Firm* — GE Global Patent Operation; Peter T. DiMauro

(57) ABSTRACT

A post mounted lamp includes: a lamp post; one or more light emitting diode (LED) devices disposed proximate to the top of the lamp post; a power factor (PF) correction circuit disposed proximate to the bottom of the lamp post; wires disposed in the lamp post to deliver PF corrected electrical power from the PF correction circuit to the one or more LED devices; and circuitry disposed proximate to the top of the lamp post to operate the one or more LED devices using the PF corrected electrical power.

14 Claims, 5 Drawing Sheets

(58) Field of Classification Search
USPC ..... 315/201
See application file for complete search history.

(56) References Cited

U.S. PATENT DOCUMENTS

| | | | | |
|---|---|---|---|---|
| 2008/0018261 | A1 | 1/2008 | Kastner | |
| 2009/0046449 | A1* | 2/2009 | Li | F21S 8/086 362/153.1 |
| 2009/0224689 | A1* | 9/2009 | Yang | H05B 33/0809 315/291 |
| 2009/0303703 | A1* | 12/2009 | Kao | F21S 8/086 362/183 |
| 2010/0214744 | A1* | 8/2010 | Liang | 361/714 |
| 2011/0241569 | A1* | 10/2011 | Zimmermann | H05B 33/0815 315/301 |

FOREIGN PATENT DOCUMENTS

| | | | |
|---|---|---|---|
| CN | 201045461 | Y | 4/2008 |
| CN | 101321421 | A | 12/2008 |
| CN | 101377275 | A | 3/2009 |
| CN | 101614358 | A | 12/2009 |
| CN | 201608948 | U | 10/2010 |
| DE | 102008057333 | | 5/2010 |
| EP | 2204898 | | 7/2010 |
| JP | 05211096 | A | 8/1993 |
| JP | 2001351789 | A | 12/2001 |
| JP | 2004319472 | A | 11/2004 |
| JP | 2007267036 | A | 10/2007 |
| JP | 2008282855 | A | 11/2008 |
| JP | 3162763 | U | 9/2010 |
| WO | WO2007102106 | | 9/2007 |
| WO | 2009012314 | | 1/2009 |

OTHER PUBLICATIONS

PCT Search Report and Written Opinion from corresponding PCT Application No. PCT/US2011/049264, Dated Mar. 2, 2012.

Unofficial English Translation of Japanese Office Action issued in connection with corresponding JP Application No. 2013-533854 on Apr. 21, 2015.

Unofficial English Translation of Japanese Office Action issued in connection with corresponding JP Application No. 2013533854 on Mar. 15, 2016.

Unofficial English Translation of Chinese Office Action issued in connection with corresponding CN Application No. 201010526537.3 on Nov. 2, 2016.

Unofficial English Translation of Japanese Office Action issued in connection with corresponding JP Application No. 2013533854 on Apr. 14, 2015.

* cited by examiner

POST-MOUNTED LIGHT EMITTING DIODE (LED) DEVICE-BASED LAMP AND POWER SUPPLY FOR SAME

BACKGROUND

The following relates to the illumination arts, lighting arts, electrical power arts, and related arts.

Light emitting diode (LED) device-based lamps are employed in diverse outdoor lighting and illumination systems, such as traffic lighting, overhead lighting, billboard lighting, and so forth. In a lamp post suitable for use in such applications, a generally vertical post supports a light head comprising LED devices at an elevated position. Such lamp posts are suitably used in the context of commercial or industrial applications such as commercial signage, parking lot illumination for retail centers, malls, supermarkets, and the like, highway lighting, or so forth.

In commercial and industrial settings, the available electrical power is typically AC power, in a range of 200-480 volts (root mean square or "RMS") in typical commercial or industrial settings. Residential lighting employs voltages in this range or slightly lower, for example 110 volts in the U.S. and 220 volts in Europe.

LED-based lamps, on the other hand, are typically driven by DC power, and each LED device typically operates at relatively low voltage, e.g. a few volts or less, and relatively high current (of order a few hundred milliamperes to a few amperes current flow per LED device. The light head of a lamp post may include LED devices in series, parallel, series-parallel or other electrical configurations. To match the electrical requirements of the LED devices with the AC electrical power, a power supply is provided, which converts the high voltage AC input power to low voltage DC power suitable for driving the LED-based light head of the lamp post.

The power supply is a frequent point of malfunction or failure. In the case of lamp posts, power supply maintenance is performed by a crew of typically three persons (for example, an electrician, an lift operator, and a third "safety spotter"), at least two of which have some level of specialized training. In another approach, the power supply is located at ground level, and the converted DC power is input to the post-mounted lamp via electrical wires running up the post. This approach has the disadvantage of conducting low voltage, high current d.c. electrical power from ground level to the elevated location of the lamp, which entails high "$I^2R$" resistive power losses. In applications such as highway lighting, parking lot illumination, or so forth, a large number of lamp posts may be employed, making maintenance cost and power consumption substantial concerns.

The following discloses improved approaches that overcome the above-identified problems and others.

BRIEF SUMMARY

In some embodiments disclosed herein as illustrative examples, an apparatus comprises: a lighting apparatus comprises: a light head comprising one or more light emitting diode (LED) devices; a lamp post supporting the light head at an elevated position; a power conversion circuit disposed in the lamp post below and spaced apart from the light head, the power conversion circuit converting input AC electrical power having frequency of less than 100 hertz to transfer electrical power selected from a group consisting of (i) DC electrical power and (ii) high frequency AC electrical power having frequency of at least 400 Hertz; and circuitry disposed in the light head and electrically connected with the power conversion circuit via electrical wires running through the lamp post, the circuitry disposed in the light head being configured to operate the one or more LED devices of the light head using the transfer electrical power.

In some embodiments disclosed herein as illustrative examples, a method comprises: a lighting apparatus comprises: a lamp post; a power conversion circuit disposed at the lower end of the lamp post and configured to convert input AC electrical power to transfer electrical power having a peak voltage of at least 75 volts; a light head disposed at an upper end of the lamp post, the light head comprising one or more light emitting diode (LED) devices; and electrical wires running through the lamp post to deliver the transfer electrical power from the power conversion circuit disposed at the lower end of the lamp post to the light head to operate the one or more LED devices.

In some embodiments disclosed herein as illustrative examples, an apparatus comprises: a lighting apparatus comprises a post mounted lamp including: a lamp post; one or more light emitting diode (LED) devices disposed proximate to the top of the lamp post; a power factor (PF) correction circuit disposed proximate to the bottom of the lamp post; wires disposed in the lamp post to deliver PF corrected electrical power from the PF correction circuit to the one or more LED devices; and circuitry disposed proximate to the top of the lamp post to operate the one or more LED devices using the PF corrected electrical power.

DETAILED DESCRIPTION OF PREFERRED EMBODIMENTS

Figure 1:
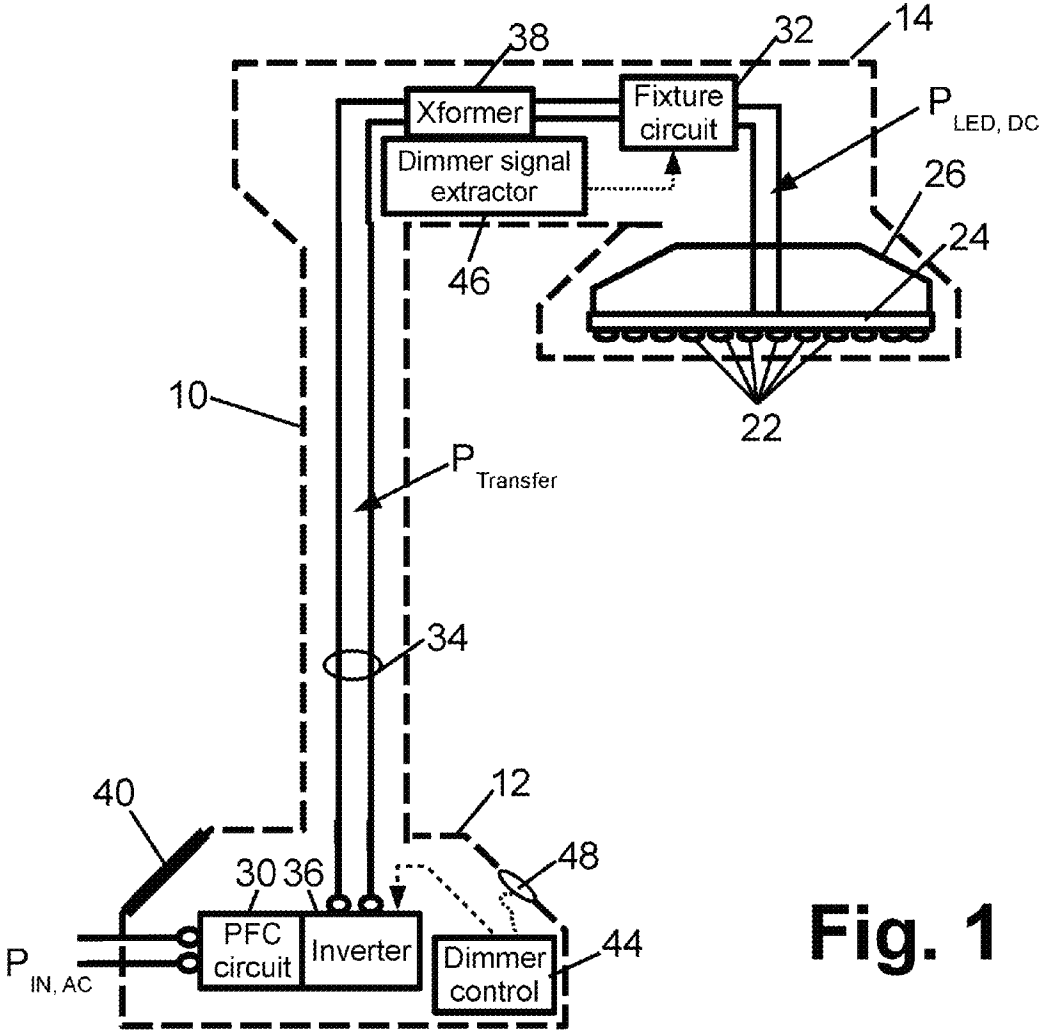
FIG. 1 diagrammatically illustrates a post-mounted LED-based lamp employing a power supply as disclosed herein.

With reference to FIG. 1, a lighting apparatus is shown, such as is suitably used for illuminating parking lots, roadways, walkways, or so forth. The lighting apparatus includes a lamp post 10, 12, which in the illustrated embodiment includes a base 12 that holds the post 10 in a generally upright position. The lamp post 10, 12 supports a light head 14 in an elevated position. The illustrative light head 14 includes light emitting diode (LED) devices 22 as the operative light emitting elements. A plurality of LED devices 22 are shown; however, it is contemplated to employ as few as a single LED device. As used herein, the term "LED device" is to be understood to encompass bare semiconductor chips of inorganic or organic LEDs, encapsulated semiconductor chips of inorganic or organic LEDs, LED chip "packages" in which the LED chip is mounted on one or more intermediate elements such as a sub-mount, a lead-frame, a surface mount support, or so forth, semiconductor chips of inorganic or organic LEDs that include a wavelength-converting phosphor coating with or without an encapsulant (for example, an ultra-violet or violet or blue LED chip coated with a yellow, white, amber, green, orange, red, or other phosphor designed to cooperatively produce white light), multi-chip inorganic or organic LED devices (for example, a white LED device including three LED chips emitting red, green, and blue, and possibly other colors of light, respectively, so as to collectively generate white light), or so forth. The one or more LED devices 22 may be configured to collectively emit a white light beam, a yellowish light beam, red light beam, or a light beam of substantially any other color of interest for a given lighting application.

The illustrative light head 14 is configured as a downlight in which LEDs 22 are mounted on a substrate 24 in an arrangement that provides illumination in a generally downward direction. More generally, the light head can have other configurations so as to produce other illumination distributions, such as a substantially omnidirectional illumination distribution or so forth. The illustrative light head 14 includes a generally horizontal portion to displace the downlighting from the location of the lamp post 10, 12; however, other configurations are contemplated, including light head designs that are symmetrical and centered at the top of the post. While the illustrative substrate 24 is planar, for other applications such as omnidirectional illumination the substrate may have other geometries such as spherical, ellipsoidal, polygonal, cylindrical, or so forth. The substrate 24 optionally includes electrical distribution circuitry (not shown) for distributing electrical power to the plurality of LED devices 22 (for example, by embodying the substrate 24 as a suitably configured circuit board or arrangement of circuit boards), and the electrical distribution circuitry may include electrical or electronic components such as voltage dividing resistors for controlling the distribution of voltage to the LED devices 22, Zener diodes or other electrostatic discharge (ESD) protection devices, protective current limiting resistors, or so forth. The illustrated post 10 is shown as a straight post in a vertical orientation, but some cant or tilt of the generally vertical post is also contemplated, for example to cause the lamp to overhang the roadway or other illuminated area, and moreover the generally vertical post may have one or more curved portions, piecewise linear portions, or other nonstraight portions. The delineation between the post 10 and the lamp head 14 may be imprecise—for example, an upper end of the post may curve toward the horizontal to gradually transition into the light head. Optionally, the light head 14 may include optical components such as reflectors, reflective baffles, or so forth (not shown) in order to optimize the downward illumination or other desired illumination distribution. Some examples of optical component arrangements are described, for example, in International Publication WO 2009/012314 A1 published 22 Jan. 2009. The illustrative light head 14 also includes a heat sink 26 for dissipating heat generated by the LEDs 22, and may optionally include other operative components such as an ambient light sensor (not shown) for automatically turning the LED devices 22 on or off responsive to the day/night cycle.

With continuing reference to FIG. 1, the light head 14 is disposed at the upper end of the lamp post 10, 12 and includes the aforementioned one or more LED devices 22. The lighting apparatus receives input electrical power $P_{IN,AC}$ at the lower end of the lamp post 10, 12 for example via the base 12. In some embodiments, the electrical power $P_{IN,AC}$ is delivered via an underground (or, more generally, under-concrete or other buried) electrical cable (not shown). The electrical power $P_{IN,AC}$ is single-phase or multi-phase AC electrical power, typically with a predominantly sinusoidal waveform, although substantial deviations from sinusoidal are contemplated such as large higher order harmonic components or so forth. The electrical power $P_{IN,AC}$ is typically at least 100 volts root-mean-square (RMS) and typically less than 480 volts RMS, for example being in a range of 200-480 volts RMS in typical commercial or industrial settings, or 110 volts in some residential settings in the United States, or 220 volts in Europe and in some U.S. residential settings. The electrical power $P_{IN,AC}$ has a line frequency less than 100 Hz, for example typically 60 Hz in the United States, or typically 50 Hz in Europe. It is understood that higher order harmonic components of the electrical power $P_{IN,AC}$ may have frequencies higher than 100 Hz.

The electrical power supply for driving the one or more LED devices 22 using the input electrical power $P_{IN,AC}$ is divided between: (1) a power factor (PF) correction circuit 30 disposed at a lower end of the lamp post 10, 12, namely in the base 12 in the embodiment of FIG. 1, and (2) a fixture circuit 32 disposed at an upper end of the lamp post 10, 12, for example in the light head 14 in the illustrative embodiment of FIG. 1. The fixture circuit 32 outputs operating DC power $P_{LED,DC}$ that operates the one or more LED device 22.

More generally, power conversion circuitry is disposed at the lower end of the lamp post 10, 12, for example in the base 12, which converts the input electrical power $P_{IN,AC}$ to transfer electrical power $P_{Transfer}$ that is at a higher voltage, such as at least 75 volts (peak voltage), and in some embodiments at least 144 volts (peak voltage). The illustrative power conversion circuitry includes the PF correction circuit 30 which (i) performs power factor (PF) correction on the input electrical power $P_{IN,AC}$ and (ii) performs AC/DC conversion on the input electrical power $P_{IN,AC}$. The PF-corrected DC electrical power optionally serves as the transfer electrical power that is delivered to the light head 14 via wires 34 passing through the post portion 10 of the lamp post 10, 12 (see, for example, the illustrative variant embodiment of FIG. 5 in which the transfer electrical power is DC transfer electrical power $P_{transfer,\ DC}$ taken directly from the PF correction circuit 30).

Alternatively, as in the embodiment illustrated in FIG. 1, the power conversion circuitry disposed at the lower end of the lamp post 10, 12 further includes an inverter 36 that converts the PF-corrected DC electrical power to AC transfer electrical power (that is, the transfer electrical power $P_{Transfer}$ is AC power in these embodiments) that is delivered to the light head 14 via the wires 34 passing through the post portion 10 of the lamp post 10, 12. For either DC or AC transfer electrical power $P_{Transfer}$, the transfer electrical power $P_{Transfer}$ is preferably of relatively high voltage, for example at least 75 volts (peak voltage), and in some embodiments at least 144 volts (peak voltage), and correspondingly low electrical current, so that the resistive ($I^2R$) losses in the wires 34 are reduced. Optionally, a transformer 38 disposed at the upper end of the lamp post 10, 12, for example in the light head 14, can adjust a frequency of the AC transfer electrical power $P_{Transfer}$ before input to the fixture circuit 32. (The transformer 38 can be omitted in the case of DC transfer electrical power $P_{Transfer}$ or in embodiments in which the frequency of the AC transfer electrical power $P_{Transfer}$ is suitable for input directly to the fixture circuit 32).

The power supply circuitry is divided between (i) a power conversion circuit comprising the PF correction circuit 30 and optionally also comprising the inverter 36 disposed in the base 12 or lower end of the lamp post 10, 12 and (ii) circuitry 32, 38 (and, optionally, the inverter 36, see e.g. FIG. 5) disposed in the light head 14 or at the upper end of the lamp post 10, 12 for operating the one or more LED devices 22 using transfer electrical power $P_{Transfer}$ received from the power conversion circuit via the wires 34 passing through the post 10. This divided arrangement has numerous advantages.

In terms of maintenance, it places the AC/DC conversion component 30 at the lower end of the lamp post 10, 12, where it can be accessed by a maintenance person at ground level without the use of a lift truck or other elevating apparatus. In the embodiment of FIG. 1, the base 12 includes an access panel 40 via which a maintenance person can access the PF correction circuit 30 to perform repair or replacement. In general, the AC/DC conversion circuitry tends to have the highest rate of failure or malfunction amongst the components of a typical power supply. Accordingly, by placing this component at ground level (that is, disposed proximate to the bottom of the post 10, 12 at a height of no more than two meters), repairs of this high-maintenance component can be performed by a single maintenance person without the need for elevating equipment.

On the other hand, it is recognized herein that it would be disadvantageous to locate the entire power supply circuitry at the lower end of the lamp post. This is because LED devices are operated at low voltage and high current. For example, a single LED device typically operates at a few volts and at a current of an ampere or higher. Depending on the number of LED devices and the type of electrical interconnection of the one or more LED devices 22 (e.g., series interconnection, parallel interconnection, series-parallel interconnection, or so forth), the operating voltage and current for the one or more LED devices 22 may be somewhat higher voltage and lower current as compared with a single LED device. However, the one or more LED devices 22 are typically operated at a current of several amperes or higher. If the entire power supply circuitry was disposed at the lower end of the lamp post, then the electrical current flowing through the wires 34 would be undesirably high and would lead to high resistive ($I^2R$) power losses.

Accordingly, in the divided power supply arrangement of FIG. 1, the PF correction circuit 30 is disposed in the base 12 or lower end of the lamp post 10, 12. The circuitry in the base 12 outputs the transfer electrical power $P_{Transfer}$ at a relatively high voltage (e.g., 75 volts peak or higher, and in some embodiments 144 volts peak or higher), which reduces resistive ($I^2R$) losses in the wires 34. The remaining circuitry 32, 38 (and, optionally, the inverter 36 as shown in the illustrative embodiment of FIG. 5) which is disposed in the light head 14 or at the upper end of the lamp post 10, 12 for operating the one or more LED devices 22 is generally more reliable. Accordingly, even though the circuitry disposed in or proximate to the light head 14 may be mounted too high to reach without the use of lift equipment (that is, the circuitry 32, 38 may be disposed proximate to the top of the lamp post 10, 12 at a height of at least three meters), the need to use lift equipment to reach these components is not as problematic due to their higher reliability.

The use of AC transfer electrical power $P_{Transfer}$ as in the embodiment of FIG. 1 has certain advantages. It enables the use of the illustrative transformer 38 at the upper end of the lamp post 10, 12 in order to adjust the voltage/current levels after conduction over the wires 34. The AC transfer electrical power $P_{Transfer}$ preferably has a relatively high frequency, for example frequency of at least 400 Hertz, and more preferably at least 10 kHz, in order to enable the transformer 38 to be made of small size. In some embodiments the AC transfer electrical power $P_{Transfer}$ has a square waveform which facilitates efficient AC/DC conversion by the fixture circuit 32.

Another advantage of using AC transfer electrical power $P_{Transfer}$ is that the frequency can be used to encode information. For example, in the illustrative embodiment of FIG. 1, a dimmer control 44 cooperates with the inverter 36 to encode the frequency with a dimming level. The circuitry disposed at the upper end of the lamp post 10, 12 then suitably includes a dimmer signal extractor 46 (which may, for example, be a frequency-to-voltage converter) that generates a control signal input to the fixture circuit 32 to control the dimming level of the operating one or more LED devices 22. The dimmer control 44 can receive or determine the dimming level in various ways—in the illustrative example, an ambient light sensor 48 detects the ambient light level and the dimmer control 44 sets the dimming level based on the ambient light level. In this way, for example, the lamp may be turned on gradually as dusk turns to night, and may be turned off gradually as night gives way to dawn.

Having described some illustrative lighting apparatus embodiments employing the illustrative lamp post 10, 12, some illustrative examples of the circuits 30, 32, 36 are next described with reference to FIGS. 2-4.

Figure 2:
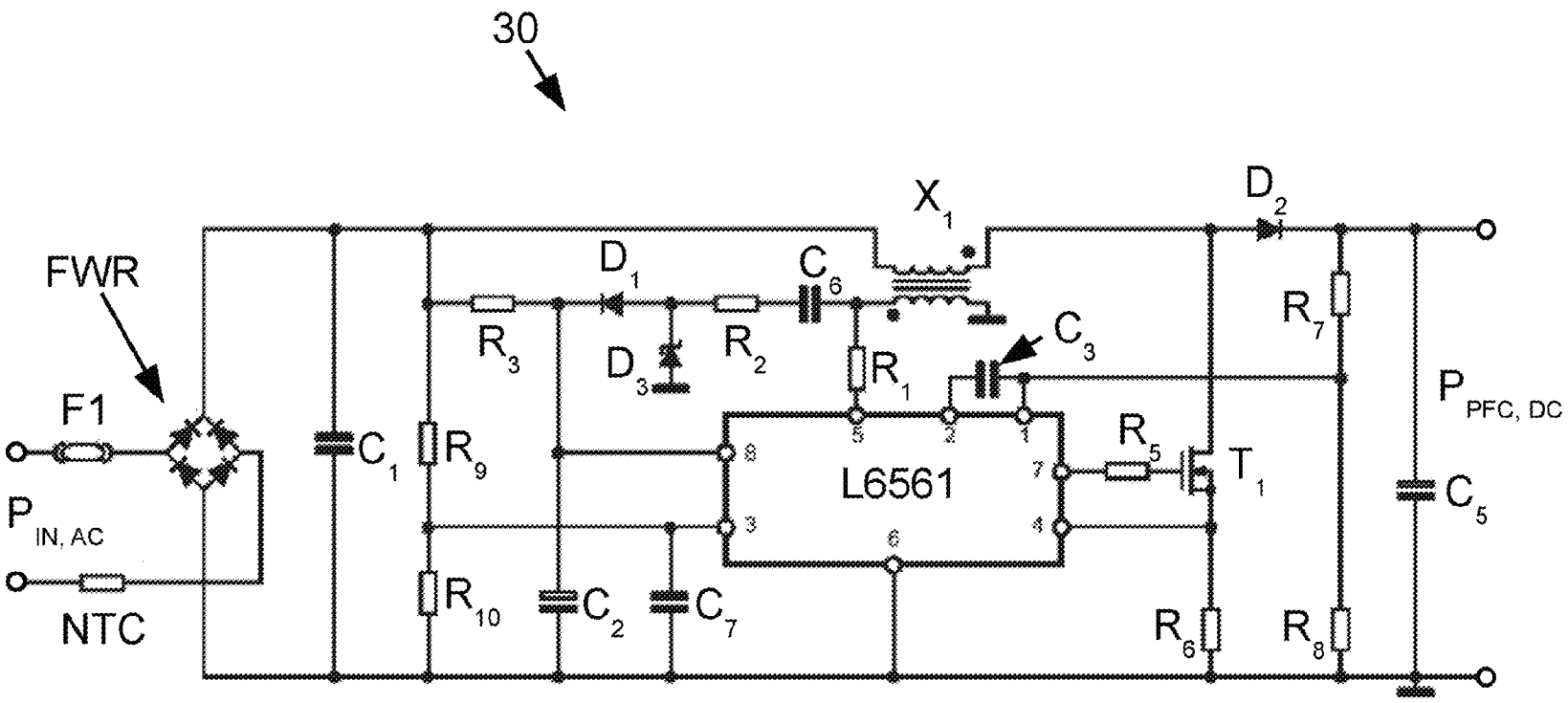
FIGS. 2-4 show electrical schematics for illustrative embodiments of components of the power supply of FIG. 1.

FIG. 2 illustrates an electrical schematic of an illustrative embodiment of the PF correction circuit 30, which includes a fuse (F1) and a temperature-sensitive component (NTC) for safety. A full-wave rectifier (FWR) rectifies the input power $P_{IN,AC}$. An automatic power factor (PF) correction integrated circuit (L6561) (available from STMicroelectronics) and components including capacitors ($C_1$, $C_2$, $C_3$, $C_5$, $C_6$), resistors ($R_1$, $R_2$, $R_3$, $R_5$, $R_6$, $R_7$, $R_8$, $R_9$, $R_{10}$), a transformer ($X_1$), diodes ($D_1$, $D_2$), and a zener diode ($D_3$), and a transistor ($T_1$) interconnected as shown in FIG. 2 define the PF correction circuit 30 which outputs a power factor (PF) corrected DC power $P_{PFC,DC}$. The PF correction circuit 30 can be constructed to provide near-unity corrected power factor (PF>0.95). In other embodiments, the illustrative PF correction circuit 30 is contemplated to be replaced by an AC/DC converter that does not provide power factor correction.

Figure 3:
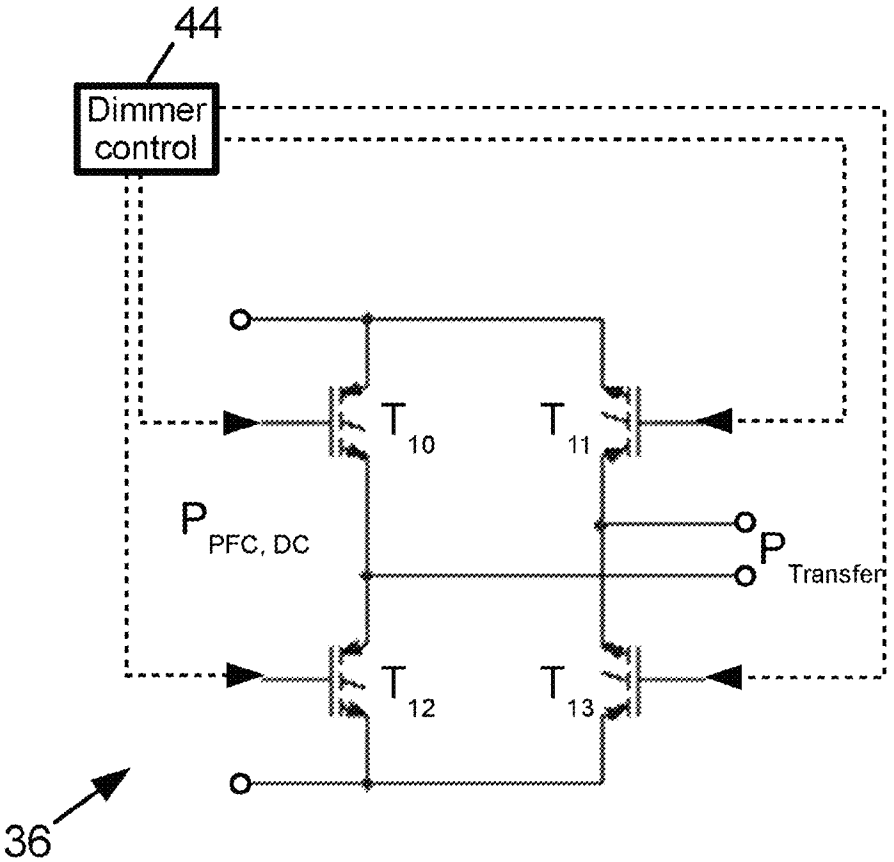

FIG. 3 illustrates an electrical schematic of an illustrative embodiment of the inverter 36, which receives the PF corrected DC power $P_{PFC,DC}$ and converts it to the AC transfer electrical power $P_{Transfer}$ having a square waveform with a peak voltage of 400 volts and a frequency of between 20 kHz and 40 kHz. The illustrative inverter 36 has an H-bridge topology and includes four transistors ($T_{10}$, $T_{11}$, $T_{12}$, $T_{13}$). In the illustrative embodiment, the dimmer control 44 provides inputs to the bases of the transistors ($T_{10}$, $T_{11}$, $T_{12}$, $T_{13}$) to encode the frequency with the dimming level.

Figure 4:
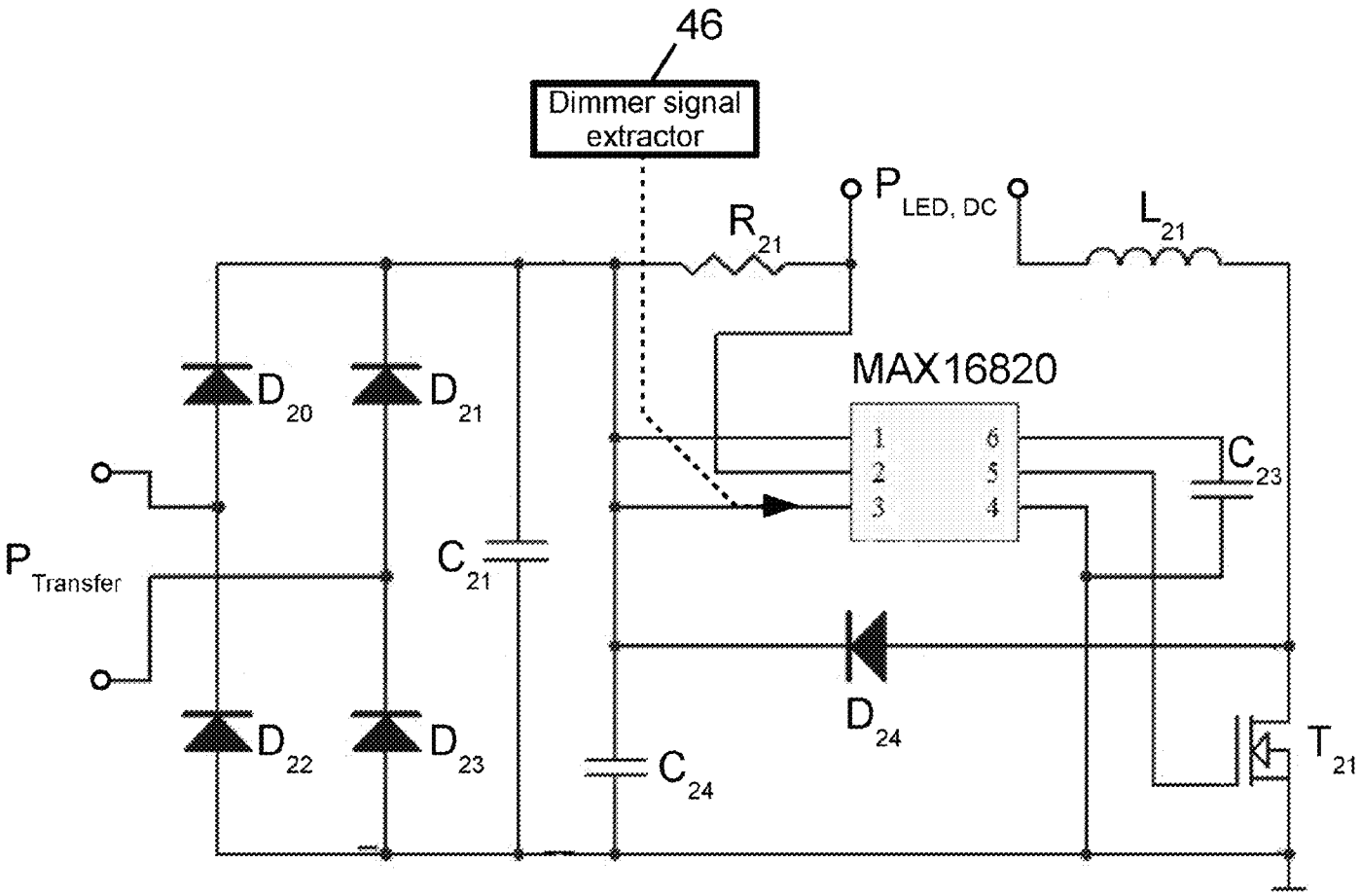

FIG. 4 illustrates an electrical schematic of an illustrative embodiment of the fixture circuit 32, which receives the AC transfer electrical power $P_{Transfer}$ (as shown in FIG. 4) or alternatively receives the AC transfer electrical power $P_{Transfer}$ after adjustment by the transformer 38 (as shown in FIG. 1). The illustrative fixture circuit 32 includes a full-wave rectifier defined by four diodes ($D_{20}$, $D_{21}$, $D_{22}$, $D_{23}$) and a smoothing capacitor ($C_{21}$). Because the AC transfer electrical power $P_{Transfer}$ has a square waveform, in principle the smoothing capacitor ($C_{21}$) could be omitted, but its inclusion advantageously provides smoothing at the square wave edge transitions. Because the smoothing capacitor ($C_{21}$) is only smoothing these transitions, it can be made relatively small, and the smoothing capacitor ($C_{21}$) does not need to be an electrolytic capacitor or storage capacitor. The fixture circuit 32 further includes a constant-current LED driver circuit based on an LED driver integrated circuit (MAX16820) (available from Maxim Integrated Products, Sunnyvale, Calif., USA) and additionally including capacitors ($C_{23}$, $C_{24}$), a resistor ($R_{21}$), an inductor ($L_{21}$), a diode ($D_{24}$), and a transistor ($T_{21}$) interconnected as shown in FIG. 4. The constant-current LED driver circuit outputs the operating DC power $P_{LED,DC}$ as constant current power that operates the one or more LED device 22. The input pin 3 of the integrated circuit (MAX16820) is a dimming input which as diagrammatically indicated in the fixture circuit 32 of FIG. 4 is optionally fed from the dimmer signal extractor 46 so as to implement dimming based on the frequency-encoded dimming level carried by the AC transfer electrical power $P_{Transfer}$. In these illustrative embodiments, the encoding runs from 20 kHz (corresponding to 0% output power, i.e. complete dimming) to 40 kHz (corresponding to 100% output power).

Figure 5:
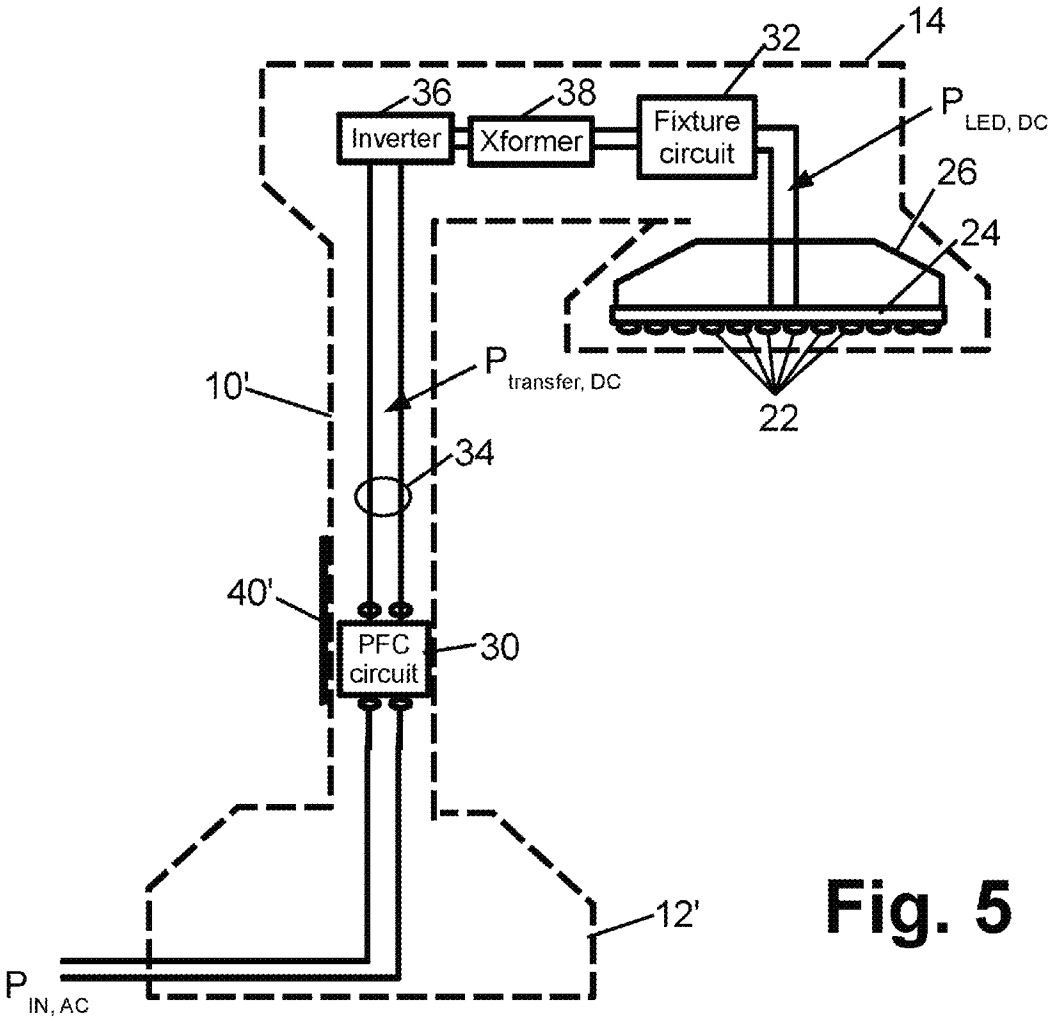
FIG. 5 diagrammatically illustrates an alternative post-mounted LED-based lamp employing the same power supply as shown in FIG. 1.

With reference to FIG. 5, a variant lighting apparatus is shown, which does not include dimming capability (and hence the components 44, 46, 48 of FIG. 1 are omitted from the embodiment of FIG. 5). Additionally, in this variant embodiment the power conversion circuit disposed in the lamp post below and spaced apart from the light head includes only the PF correction circuit 30 (but not the inverter 36) and is mounted in a modified post 10' of a modified lamp post 10', 12'. To implement this latter change, the post 10' is modified compared with the post 10 of FIG. 1 by adding an access panel 40', and conversely the base 12' is modified compared with the base 12 of FIG. 1 by omission of the base-mounted access panel 40. Preferably, the power conversion circuit disposed in the lamp post and comprising (in this embodiment) only the PF correction circuit 30 is mounted in the post 10' at a height that is accessible by maintenance personnel without the use of lifting equipment (that is, disposed proximate to the bottom of the post 10', 12' at a height of no more than two meters). In this embodiment the inverter 36 is moved into the light head 14. The circuitry 32, 36, 38 disposed in the light head 14 may again be mounted too high to reach without the use of lift equipment (that is, the circuitry 32, 36, 38 may be disposed proximate to the top of the lamp post 10', 12' at a height of at least three meters), but again the need to use lift equipment to reach these components 32, 36, 38 is not problematic due to their higher reliability. In this embodiment the power conversion circuit including only the PF correction circuit 30 outputs DC transfer electrical power $P_{transfer,\ DC}$ which preferably has a DC voltage of at least 75 volts (and hence also has a peak voltage of at least 75 volts), and in some embodiments has a DC voltage of at least 144 volts (and hence in these embodiments also has a peak voltage of at least 144 volts). In a further variant embodiment (not illustrated), the inverter can optionally output at a relatively lower voltage (and hence relatively higher current) and the transformer 38 can be omitted. Indeed, in some such further variant embodiments, the components 32, 36, 38 disposed in the light head 14 are replaced by a DC/DC power supply that converts the DC transfer electrical power $P_{transfer,\ DC}$ output by the PF correction circuit 30 to power suitable for driving the one or more LED devices 22.

The preferred embodiments have been illustrated and described. Obviously, modifications and alterations will occur to others upon reading and understanding the preceding detailed description. It is intended that the invention be construed as including all such modifications and alterations insofar as they come within the scope of the appended claims or the equivalents thereof.

What is claimed is:

1. A lighting apparatus comprising:

a light head comprising one or more light emitting diode (LED) devices;

a lamp post supporting the light head at an elevated position;

a power conversion circuit disposed in the lamp post below and spaced apart from the light head, the power conversion circuit converting input AC electrical power having frequency of less than 100 hertz to transfer high frequency AC electrical power having frequency of at least 400 Hertz, wherein the power conversion circuit comprises a power factor (PF) correction circuit that performs power factor (PF) correction on the input AC electrical power and performs AC/DC conversion generating DC electrical power, and an inverter circuit converting the DC electrical power to transfer power comprising AC electrical power having a square waveform; and circuitry disposed in the light head and electrically connected with the power conversion circuit via electrical wires running through the lamp post, the circuitry disposed in the light head being configured to operate the one or more LED devices of the light head using the transfer electrical power, wherein the circuitry disposed in the light head comprises a constant current source configured to operate the one or more LED devices of the light head at a constant drive current using the transfer electrical power.

2. The lighting apparatus as set forth in claim 1, wherein the lamp post includes a base and the power conversion circuit is disposed in the base.

3. The lighting apparatus as set forth in claim 1, wherein the power conversion circuit is disposed proximate to the bottom of the post at a height of no more than two meters and the lamp post supports the light head at a height of at least three meters.

4. The lighting apparatus as set forth in claim 1, wherein the power conversion circuit is configured to output the transfer electrical power as high frequency AC electrical power having frequency greater than or equal to 10 kilohertz.

5. The lighting apparatus as set forth in claim 4, wherein the power conversion circuit further comprises a dimmer control circuit encoding the frequency of the high frequency AC electrical power with a dimming level, and the circuitry disposed in the light head dims the one or more LED devices of the light head in accordance with the frequency of the high frequency AC electrical power.

6. The lighting apparatus as set forth in claim 1, wherein the transfer electrical power has a peak voltage of at least 75 volts.

7. The lighting apparatus as set forth in claim 1 wherein the power conversion circuit is configured to convert input AC electrical power to transfer electrical power having a peak voltage of at least 75 volts.

8. The lighting apparatus as set forth in claim 7, wherein the lower end of the lamp post includes a base and the power conversion circuit is disposed in the base of the lamp post.

9. The lighting apparatus as set forth in claim 7, wherein the power conversion circuit comprises:

an AC/DC converter configured to convert the input AC electrical power to DC electrical power; and an inverter configured to convert the DC electrical power to AC transfer electrical power having a peak voltage of at least 75 volts and a frequency of at least one kilohertz.

10. The lighting apparatus as set forth in claim 9, further comprising:

a dimmer control circuit disposed at the lower end of the lamp post and cooperating with the inverter to encode the frequency of the AC transfer electrical power with a dimming level; wherein the light head includes circuitry configured to dim the one or more LED devices in accordance with the dimming level encoded by the frequency of the AC transfer electrical power.

11. The lighting apparatus as set forth in claim 7, wherein the power conversion circuit comprises:

an AC/DC converter configured to convert the input AC electrical power to DC electrical power having a DC voltage of at least 75 volts, the DC electrical power having a DC voltage of at least 75 volts being the transfer electrical power having a peak voltage of at least 75 volts.

12. The lighting apparatus as set forth in claim 7, wherein the light head further comprises:

light head circuitry configured to convert the transfer electrical power to DC operating electrical power for operating the one or more LEDs, the DC operating electrical power having a voltage of less than 100 volts.

13. The lighting apparatus as set forth in claim 12, wherein the light head circuitry is configured to convert the transfer electrical power to constant current DC operating electrical power.

14. A lighting apparatus comprising:

a light head comprising one or more light emitting diode (LED) devices;

a lamp post supporting the light head at an elevated position;

a power conversion circuit disposed in the lamp post below and spaced apart from the light head, the power conversion circuit converting input AC electrical power having frequency of less than 100 hertz to transfer DC electrical power, wherein the power conversion circuit comprises:

an AC/DC conversion circuit generating DC electrical power; and an inverter circuit converting the DC electrical power to transfer power comprising AC electrical power having a square waveform; and circuitry disposed in the light head and electrically connected with the power conversion circuit via electrical wires running through the lamp post, the circuitry disposed in the light head being configured to operate the one or more LED devices of the light head using the transfer electrical power.

* * * * *